United States Patent [19]

Hirtz

[11] Patent Number: 4,881,469

[45] Date of Patent: Nov. 21, 1989

[54] OPERATING SYSTEM FOR HIGH SPEED TUNNEL TRAINS

[76] Inventor: Helmut Hirtz, Alemannenstrase 7, 1000 Berlin 28, Fed. Rep. of Germany

[21] Appl. No.: 86,298

[22] Filed: Jun. 29, 1987

[51] Int. Cl.[4] ..... B61B 13/10

[52] U.S. Cl. ..... 104/138.1; 104/139

[58] Field of Search ..... 104/138.1, 138.2, 139, 104/35, 49

[56] References Cited

U.S. PATENT DOCUMENTS 3,508,497 4/1970 Matsukata ..... 104/138.1

FOREIGN PATENT DOCUMENTS 1579115 8/1969 France ..... 104/138.1
2274482 6/1974 France ..... 104/138.1
1543800 4/1979 United Kingdom ..... 104/138.1

*Primary Examiner*—Henry A. Bennet
*Attorney, Agent, or Firm*—Nils H. Ljungman

[57] ABSTRACT

A one-directional tunnel system for a high-speed train includes a first tunnel section having a pair of rails for support of a train. A second tunnel section has a pair of rails for support of the train and is generally alignable with and separated from the first tunnel section. A third tunnel section has a pair of rails for support of the train and is horizontally beside the second tunnel section and separated from the first tunnel section. The first tunnel section can be selectively joined to one of the second tunnel section and the third tunnel section by at least one first tunnel switching section which is rotatable about an axis generally parallel to the first tunnel section. The first tunnel switching section has a first tunnel portion including a pair of the rails for support of the train and is alignable with the first tunnel section and the second tunnel section and the pair of rails thereof. The first tunnel switching section also has a second tunnel portion having at least one rail for support of the train and is alignable with the first tunnel section and the third tunnel section and the pair of rails thereof. The first tunnel portion and the second tunnel portion of the first tunnel switching section are on opposite sides of the axis.

16 Claims, 11 Drawing Sheets

Figure 3:
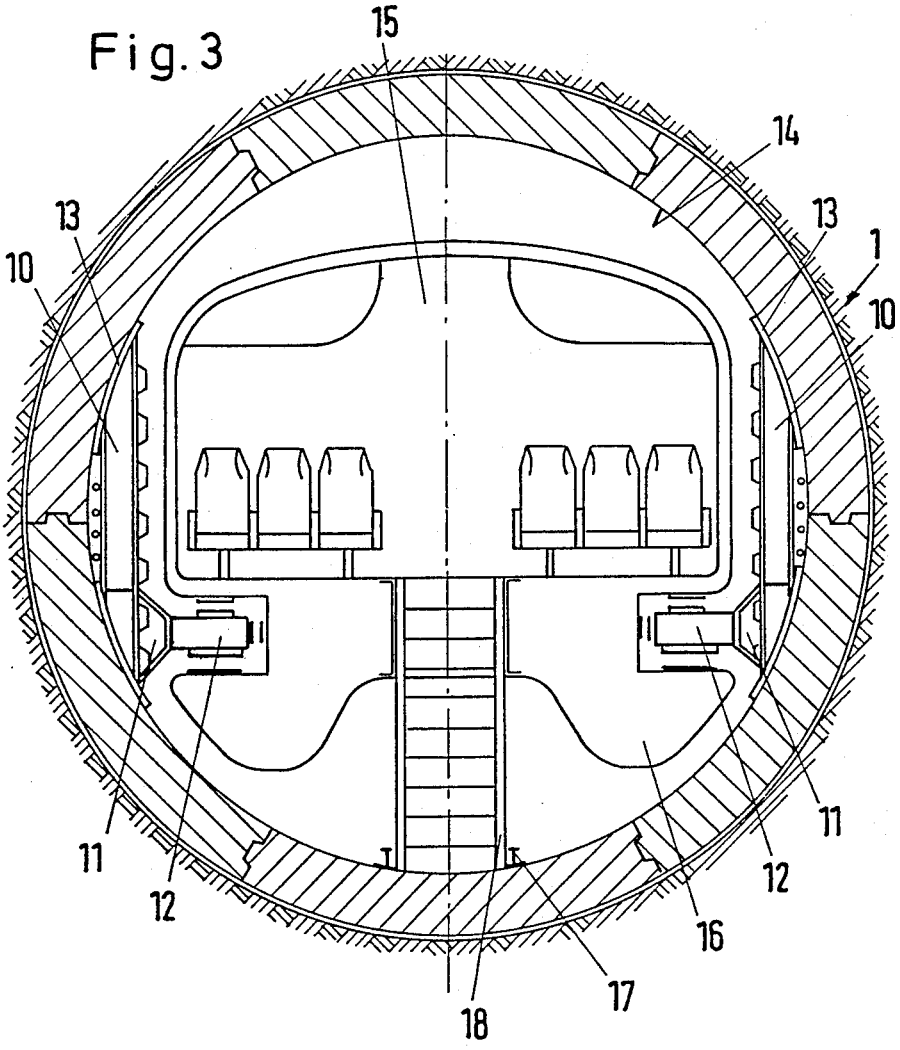

Fig. 1b
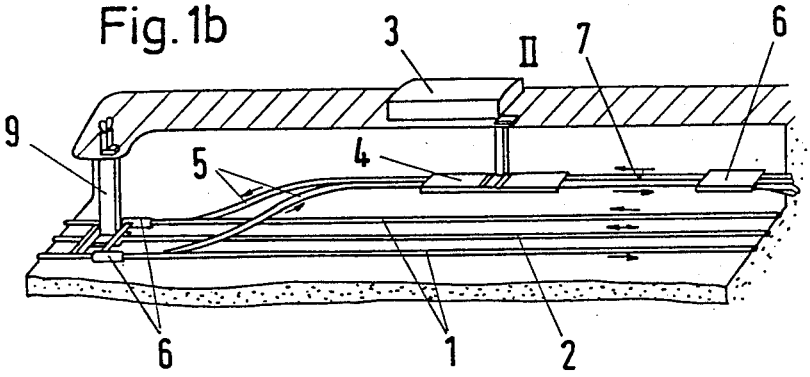
Fig. 2b
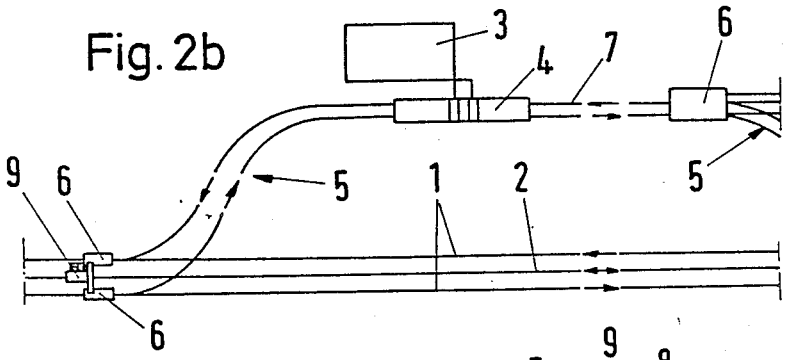
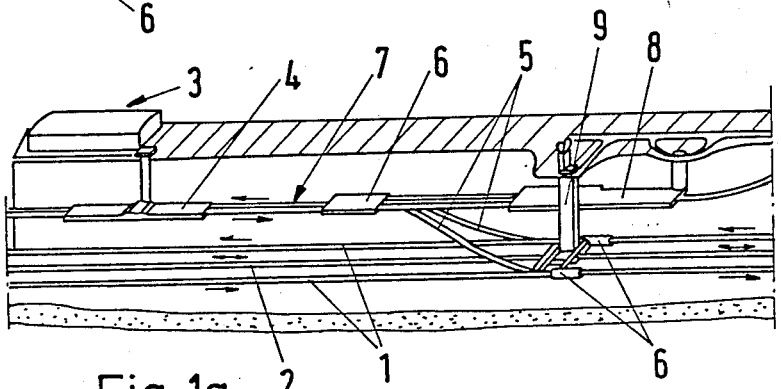
Fig. 1a
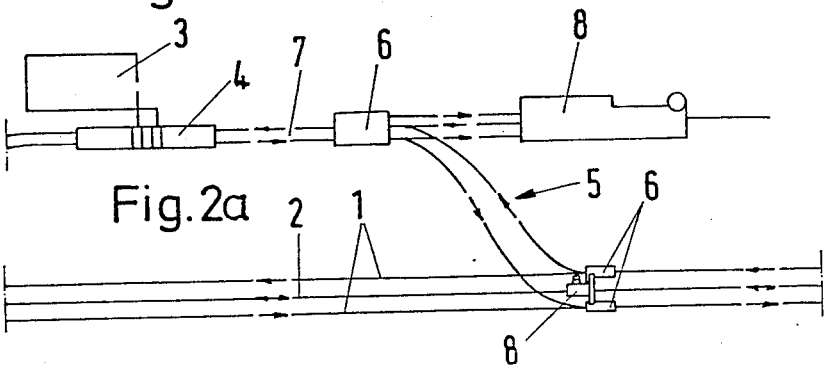
Fig. 2a

OPERATING SYSTEM FOR HIGH SPEED TUNNEL TRAINS

The invention relates to an operating system according to the scope of the patent claim 1.

For the urgent solution of the cropping up transportation problems, a track-riding long distance transportation means of a higher traveling speed, which runs underground, should be made available.

This track-riding long distance transportation means should directly connect centers of agglomerations or other centers with one another, which presently are exclusively connected with one another by above-ground track-riding long distance transportation means. It has been shown, for example, that airplanes of comparable transportation capacity have had for years at a minimum a 10 times larger power requirement per seat than a track-riding long-distance transportation means which is driven at a traveling speed of 400 km/hr.

The problem underlying the invention is to provide an operating system for a transportation means of this type.

According to the invention, this problem is solved through the technical teaching of claim 1.

Advantageously, high speed trains consequently are run exclusively in a directional tunnel or, respectively, in two tunnels in a directional operation directly from one traffic center of an agglomeration to a traffic center of the next agglomeration. The transportation directly from a town center to a town center can take place exclusively in the closed tubes of the directional tunnel, wherein those can be arranged at a depth which moreover precludes any injury to the surface utilization. The traveling speed further can preferably lie above 200 km/hr, and the distance between train stations should be as a rule larger than 100 km. Especially in densely inhabited areas, the most favorable run of the line can be chosen independently of the existing utilization. Dynamic travel shortcomings of air blasts during the transition from surface to tunnel transportation and vice versa can be avoided. An appropriate car design for the tunnel traffic can be employed, i.e., there can be provided, among others, no windows. Because of this, the cars can be to a large extent soundproofed and vibration damped. The same is true with respect to the reduction of aerodynamic resistance.

The tubes of the directional tunnel have a constant profile over their entire travel length. At traffic centers the train stations lie in branch tunnels running parallel to the directional tunnel. At the branching points, sections of tubes of the directional tunnels, which runs in a straight line, and of the branch tunnel are designed as switches in that the wall elements of the directional tunnel and/or of the branch tunnel are built slidable into each other and/or relative to each other and/or rotatable. At those branching points, two types of operations are possible. In passing by the station in the directional tunnel, which forms the distance tunnel, the tube of the directional tunnel at the branching point remains closed. In a travel to the station, the tube of the directional tunnel is opened at the branching location to the branching tunnel through the special design of the wall elements of the directional tunnel and/or of the branch tunnel.

With this operating system, the stations and the tunnel sections associated therewith can lie at the same level. Preferably, they lie at a level different from the level of the directional tunnel. Especially, the stations and their tunnel sections lie above the directional tunnel.

For the advance work and for repairs and general operating purposes, at least one operating tunnel may advantageously run between the directional tunnels.

In this transportation system, there are provided in each case two parallel directional tunnels.

With the operating system, passenger traffic can be served in the first place. Use of auto travel trains is, however, also possible. Additionally, there exists a possibility of hauling container-express freight on trains designed for equal speed.

The network can be operationally separated from other means of transportation but also may be run in association therewith.

The transportation will be carried out exclusively with trains especially optimally designed for these purposes, for example, in two directional tunnels, in directional operation. Beyond the entrances and exits above the stations and aeration and venting centers, no ground or land is claimed. Encroachments on the rights of landowners can be eliminated.

The stations, arranged underground, may be passenger stations or freight stations. The passenger stations are therefore located directly under the existing traffic junctions of the adjacent centers, such as railroad stations or central airports. From these passenger stations can lead, respectively, sidings for the shipping installations for auto travel trains as well as for container express freight. These installations can be connected by ramps for the motor vehicle traffic to the street network.

Any impairment of the environment is precluded.

Advantageously, the high speed trains can be magnetic trains driven by linear motors.

The ventilation system can be built for this in such a manner that the longitudinal flow of the tunnel air is produced in the travel direction, so that the trains can be additionally accelerated like a pneumatic mail system. There exists, however, also the possibility of laying out the operational system in such a manner that in each case before a running train a reduced pressure and/or behind it an overpressure is produced. Further, axial compressors can be installed on or in the train for acceleration. For easier running of the trains, these can have, especially in the longitudinal direction, a profile of such a kind that it produces a lift. A lift generation can further be produced by a cross-sectional configuration of the tunnel which has the effect that the flow velocity above the train is higher than underneath.

Because the stations are arranged in parallel tunnels, which branch out of the actual directional tunnel and again lead back to it, there exists the possibility of blocking off the stations with respect to the air coming from the directional tunnels, so that the air blasts originating from the passing trains can be kept away from the stations by suitable barrier installations at the branching points.

In this operating system, the directional tunnels can be advantageously formed in such a way that on the inner wall of the directional tunnel posts are fastened on which consoles are adjustably installed. On those consoles, the drive rails are adjustably fastened. Through this construction, a simple assembly and adjustment of the drive track is possible. There are provided for the assembly two setting possibilities, which readily permit an adjustment.

Further, because of that, an adjustment of the height differences of the drive track carriers, e.g., lateral inclination, can be readily carried out. One deals here also with the lateral banking required for travels along curves. Fine tolerances can be balanced by fastening the drive track carriers on the consoles, wherein those consoles themselves likewise are adjustably mounted on the posts.

Advantageously, fastening of the posts can further be done adjustably by means of flanges and anchors. By this kind of mounting, balancing of gross tolerances can be readily accomplished.

The forces which must be taken up from the drive track, i.e., the vertical force and the horizontal force, and also the moments are most favorably directed into the tunnel wall.

In deep-lying directional tunnels, because of variable earth pressures, minute deformations may arise, which may lead to small track changes of the drive rails. In order to advantageously balance those, the tracking magnets of the magnetic train cars can be designed to balance those track changes relative to the drive rails by means of controlled adjustment motors.

At the branching points of the tubes which form the directional tunnel and the branch tunnel, switch constructions are provided, wherein one of the problems to be solved by this construction lies in maintaining essentially unchanged the track cross-section as well in the straight stretch, which is formed by the directional tunnel, as in the curved stretch, which is formed by the branch tunnel. In particular, when traveling at a very high speed along the straight stretch of the switch, which belongs to the directional tunnel, profile widenings in the form of a switch cavern, e.g., for flectional switches lead to strong accelerations and retardations.

It is within the scope of the invention that at the branching points the cylindrical directional tunnel forms an intersection with the toroid of the branch tunnel. In the area of that intersection, the directional tunnel and the toroid are subdivided into a number of switch segment sections, whereby in each switch segment section segment construction elements are formed rotatable and/or slidable. The subdivision of the tunnel into switch segment sections provides the possibility, especially for the straight stretch of the switch, to preserve the required constancy of the profile and closed condition, which is of importance for the travel at high speeds. In the branch tunnel, which has a toroidal shape, traffic at lower speeds takes place. In this toroid, very small profile changes for the travel along the curve in the curved stretch can be tolerated. In a preferred embodiment, the toroid of the branch tunnel exhibits in the intersection area in the wall section adjacent the directional tunnel sector-shaped cutouts. Cylindrical walls of rotational cylinder segments extend with a snug fit into these sector-shaped cutouts, whereby each cylinder wall of the rotational cylinder segment exhibits a convex, retracted, cylindrical shape whose radius of curvature is equal to the inner radius of the toroid, wherein a drive rail extends outwardly from this convex, retracted section. In each rotational cylinder segment, a switch section of the directional tunnel is mounted at an angular spacing of 180° from the convex, retracted, cylindrical section. In this embodiment, for traveling along the straight stretch of the switch, the switch segment in the rotational cylinder in the sector-shaped section of the toroid of the branch tunnel is turned inwards. When the switch is set for traveling in the toroid, i.e., in the direction of the station, the rotational cylinder segment, which as an example is positioned on rollers and provided with an appropriate drive, is rotated so that the switch segment of the directional tunnel turns out of the sector-shaped cutout of the toroid of the branch tunnel, and the convex, retracted, cylindrical section with its drive rail is rotated inwardly in such a manner that it completes the toroid of the branch tunnel so that a driveable tunnel section is formed.

In the region at the beginning of the switch neighboring the intersection of the branching point, switch segment sections of the directional tunnel and of the toroid are mounted in a turret at an angular distance of 180° from each other cyclically rotatable for each respective operating position. For the respective intended operation, the corresponding switch segment section will be rotated into the operating position. At the same time, the other switch segment section will be automatically rotated out of it. A simpler embodiment for this section can be formed on the assumption that the profile will be kept smooth only for the straight travel, so that for the travel in the curved stretch of the toroid of the branch tunnel, the sidewall of the directional tunnel laying next to the branching is sectionally retracted like a curved rail in such a way that the profile is opened for travel along the curved stretch. At the same time, the semicylindrical sections of the tubes of the directional tunnel in the area of the intersection originating at the beginning of the switch are slideable into sections of the toroid of the branch tunnel corresponding to the geometric loci in the manner of a flectional switch. The drive rails of the associated stationary semicylindrical section of the tube of the directional tunnel are mounted in this section like a flectional switch for driving on and off. In this manner, the entire section is designed like a flectional switch.

Advantageously, a wall section common for the directional tunnel and the toroid can further be slidably installed between them in the intersection area at the end of the switch. For that, overlapping tunnel surfaces will be arranged slidably side by side and perpendicularly to the axis of the tunnel. In this switch design, for traveling along the straight stretch of the directional tunnel, the curved stretch of the branch tunnel is rotated so that it cannot admit into the curved stretch the air blast associated with the train travel along the straight stretch.

Examples of embodiments of the invention will be explained in the following description with reference to the figures of the drawing.

Figure 4:
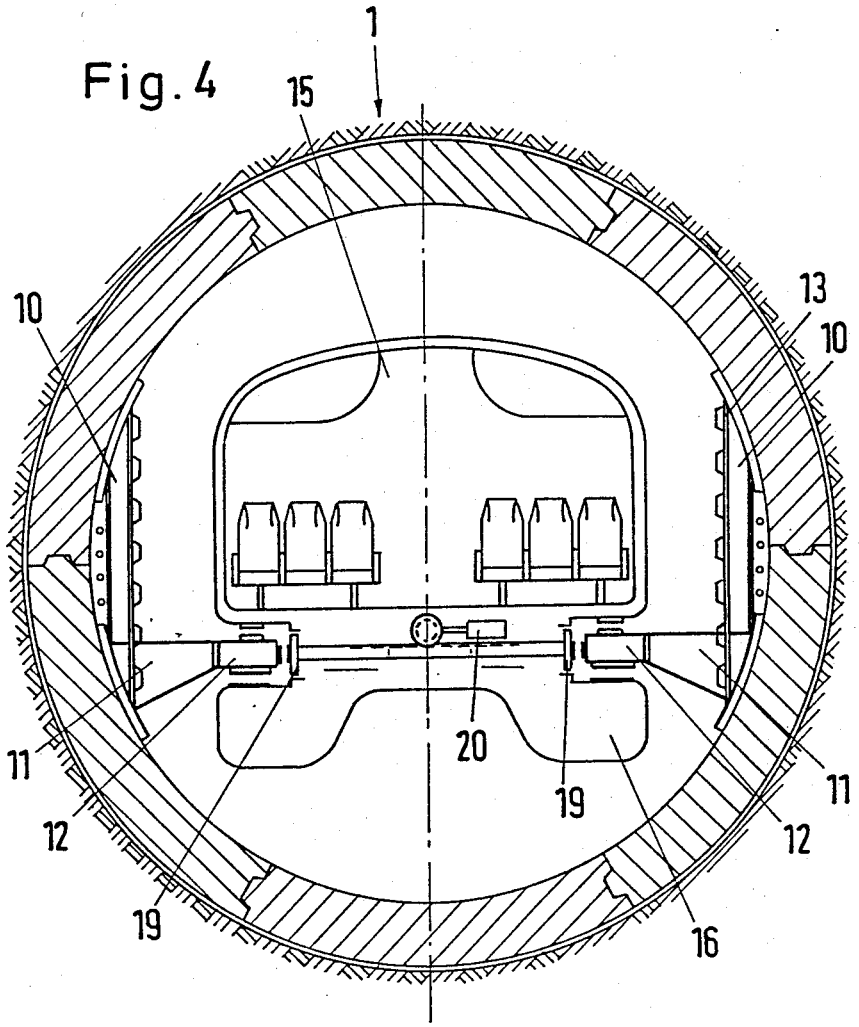
Figure 5:
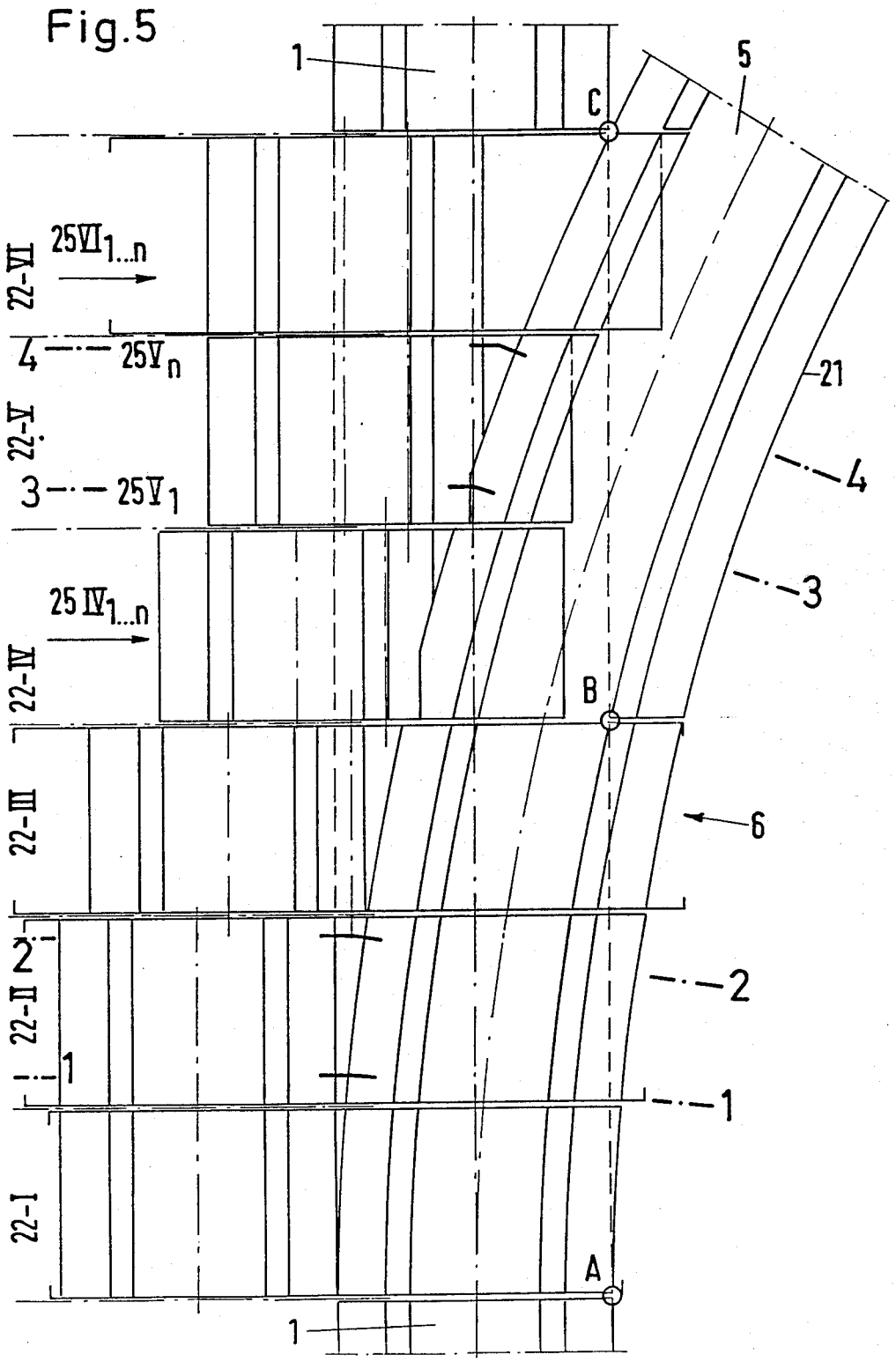
Figure 6:
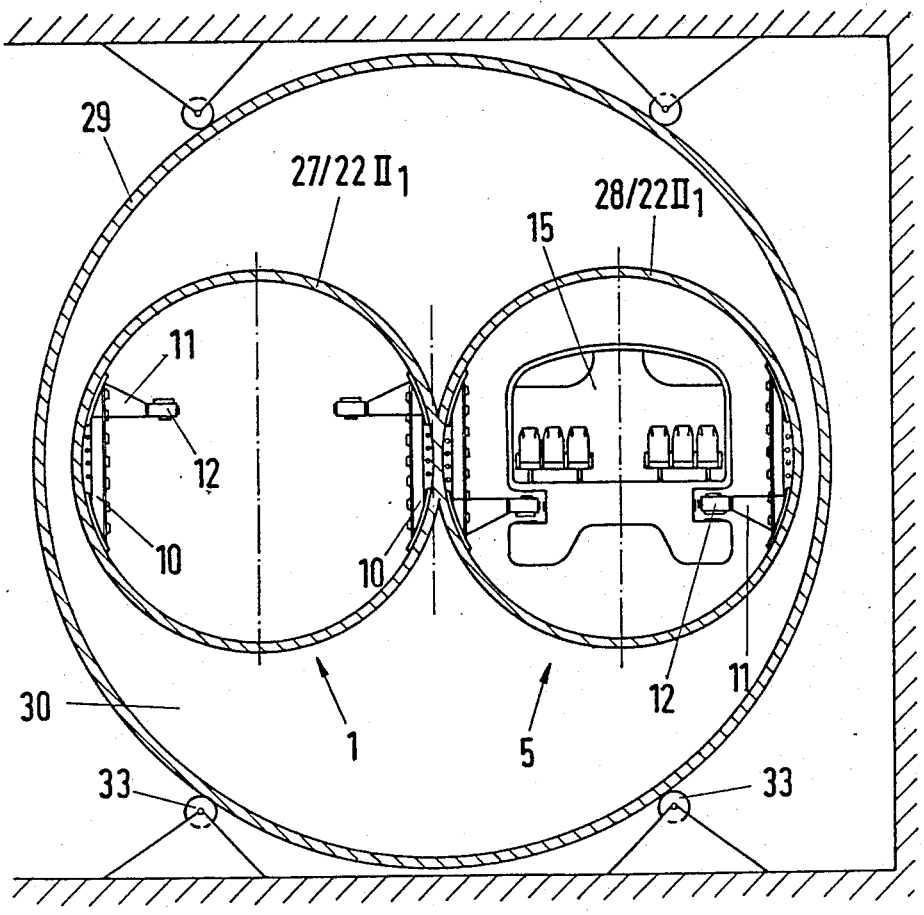
Figure 7:
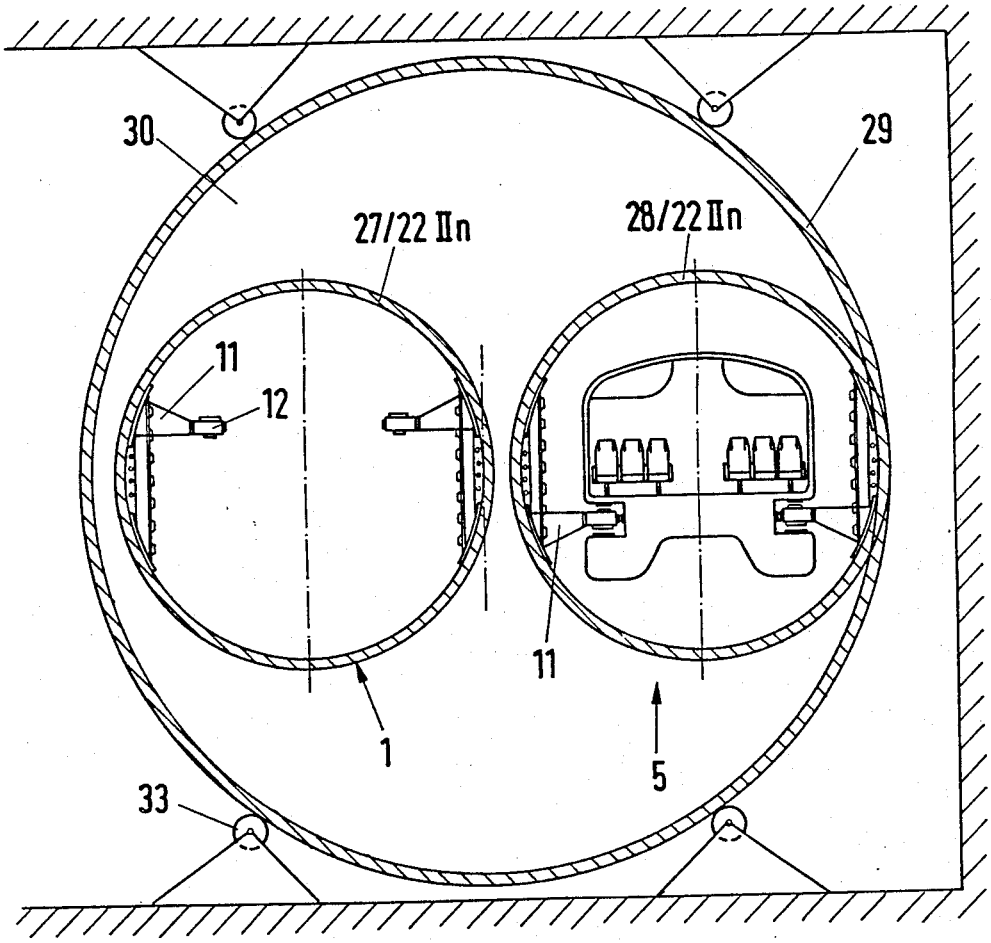
Figure 8:
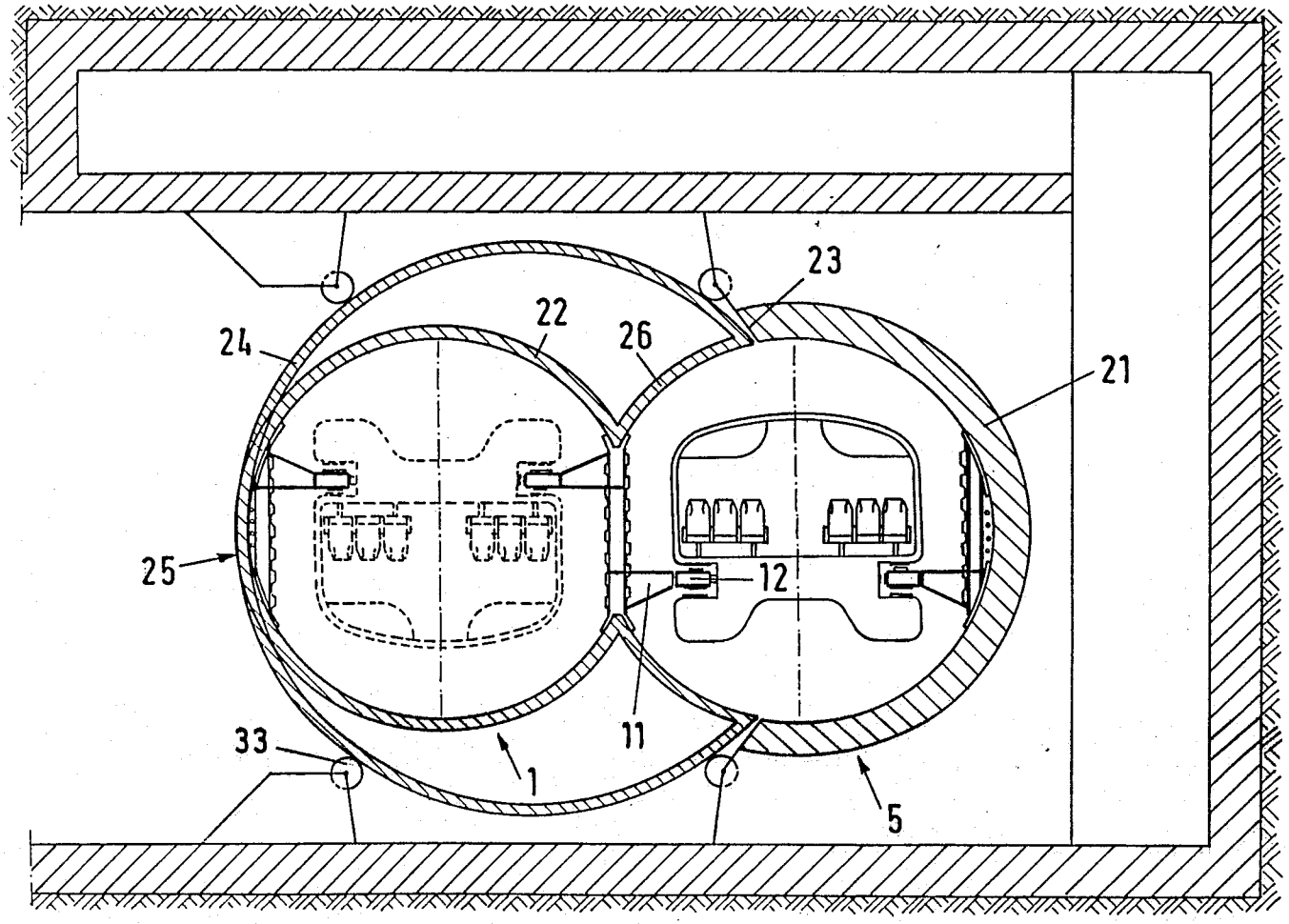
Figure 9:
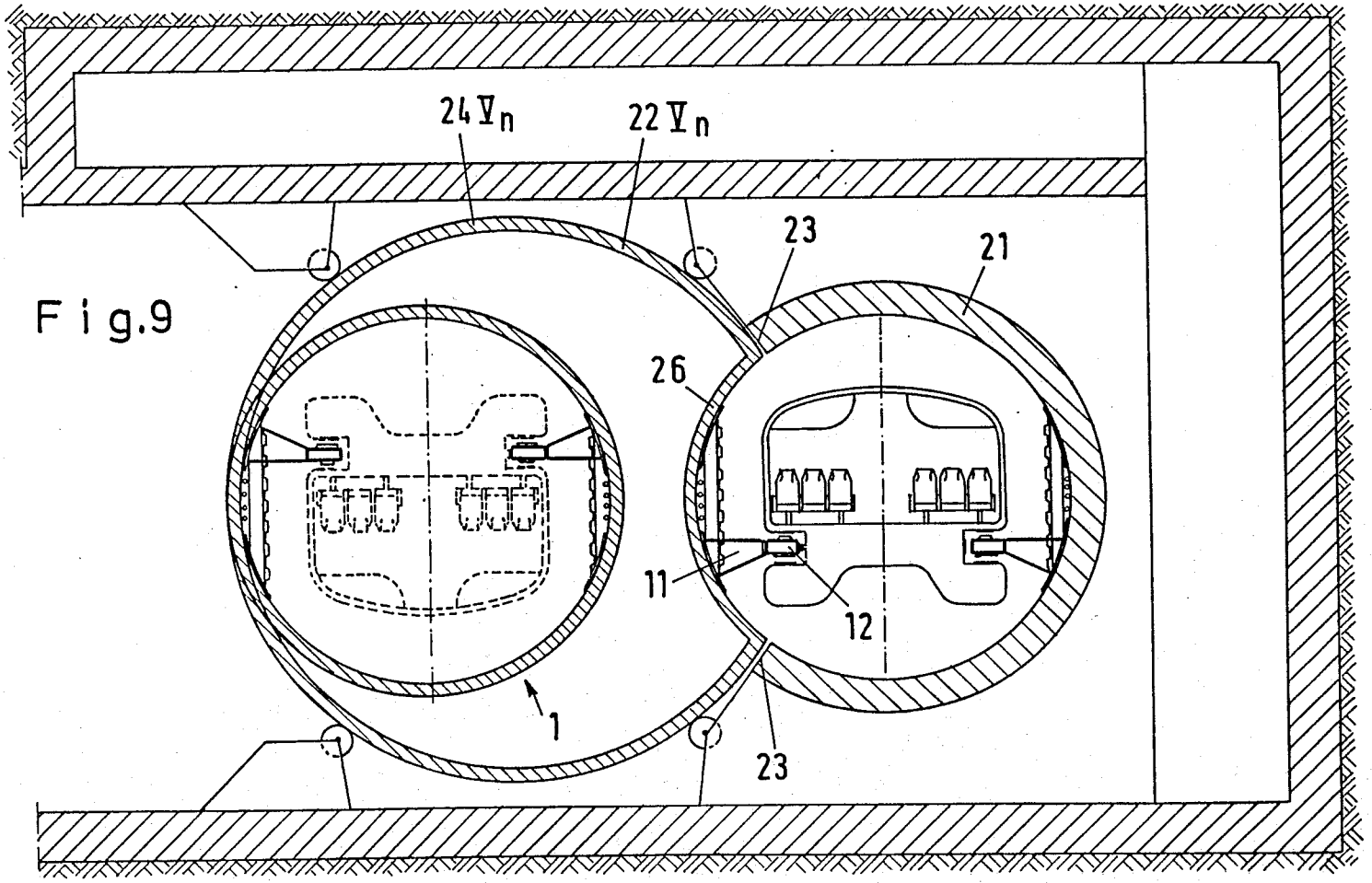
Figure 10:
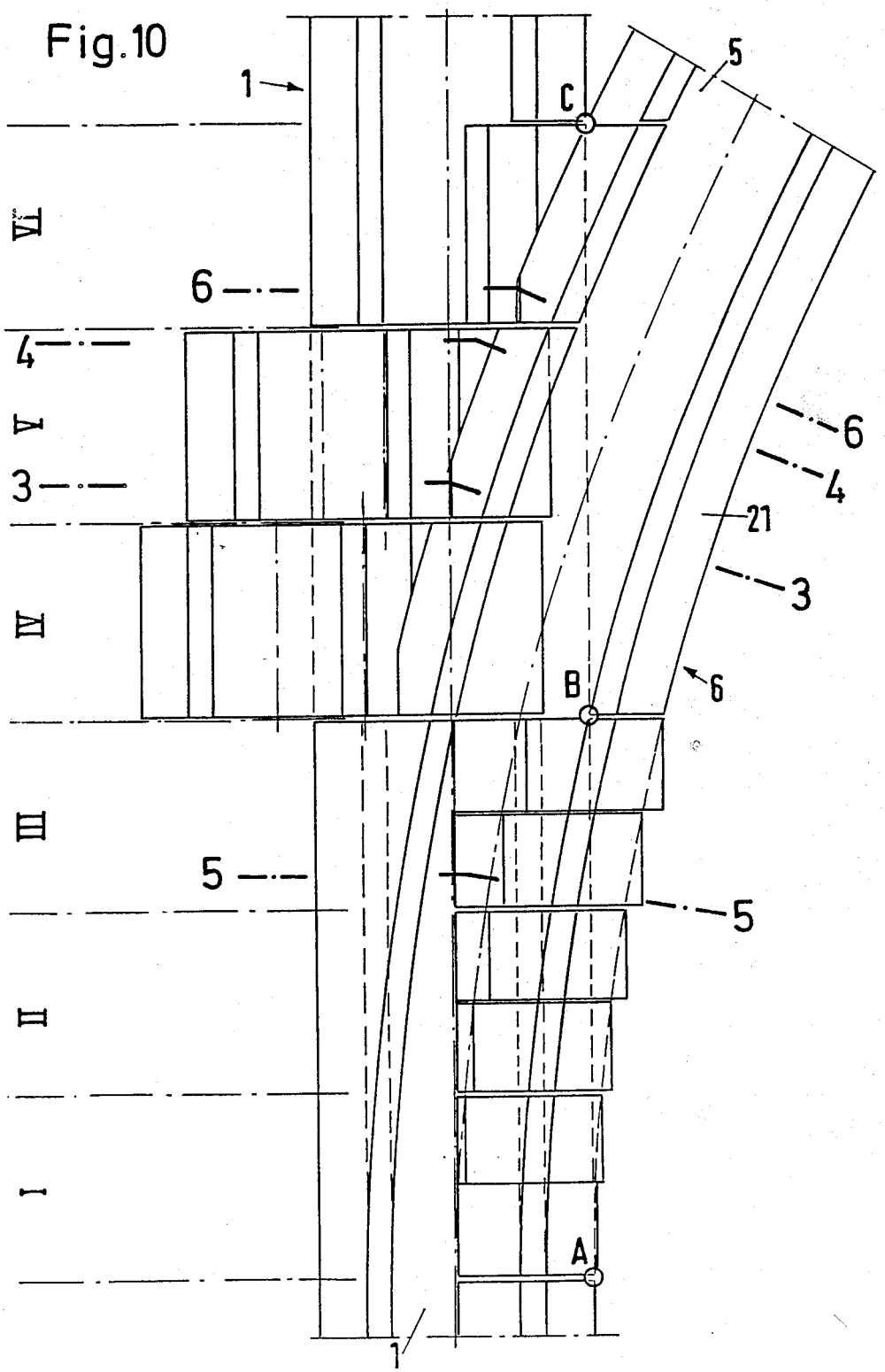
Figure 11:
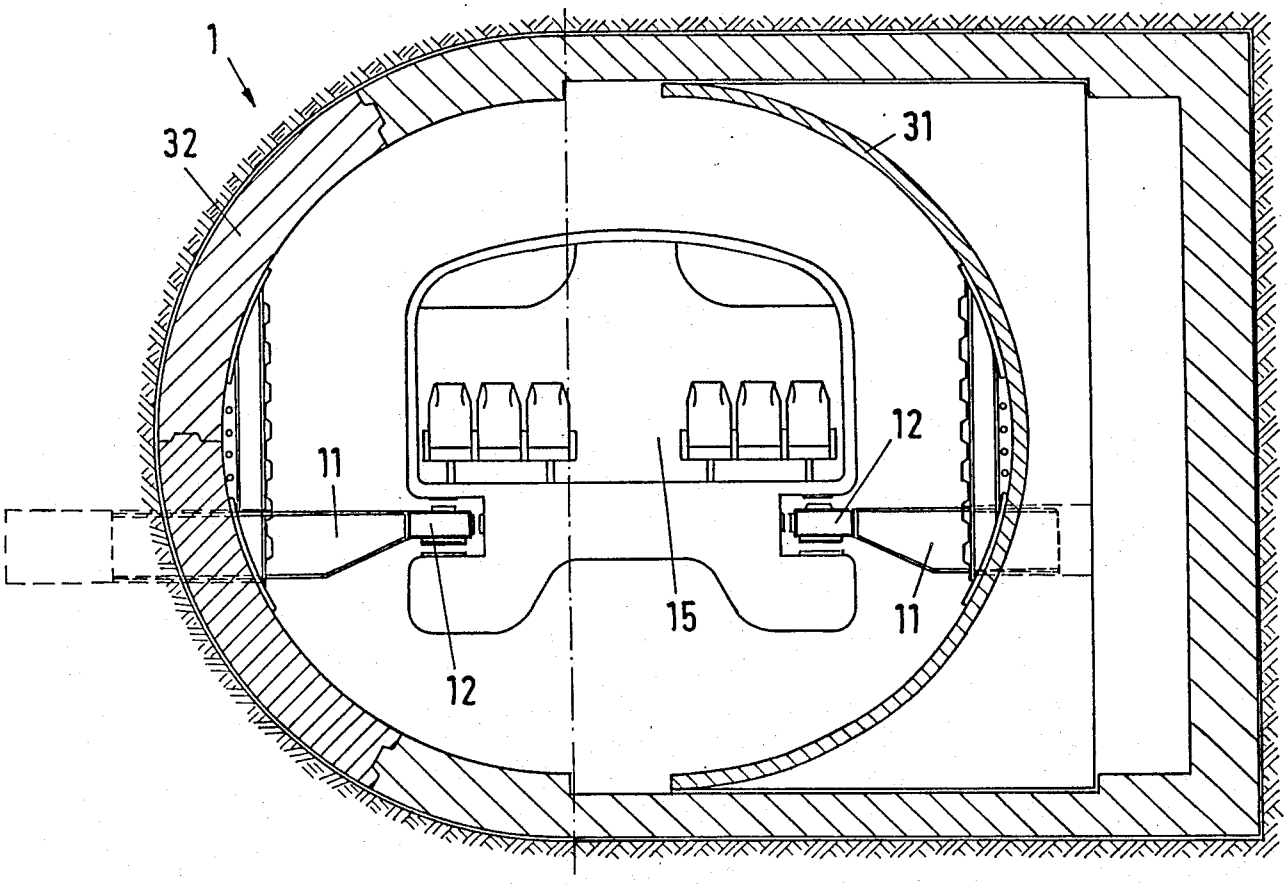
Figure 12:
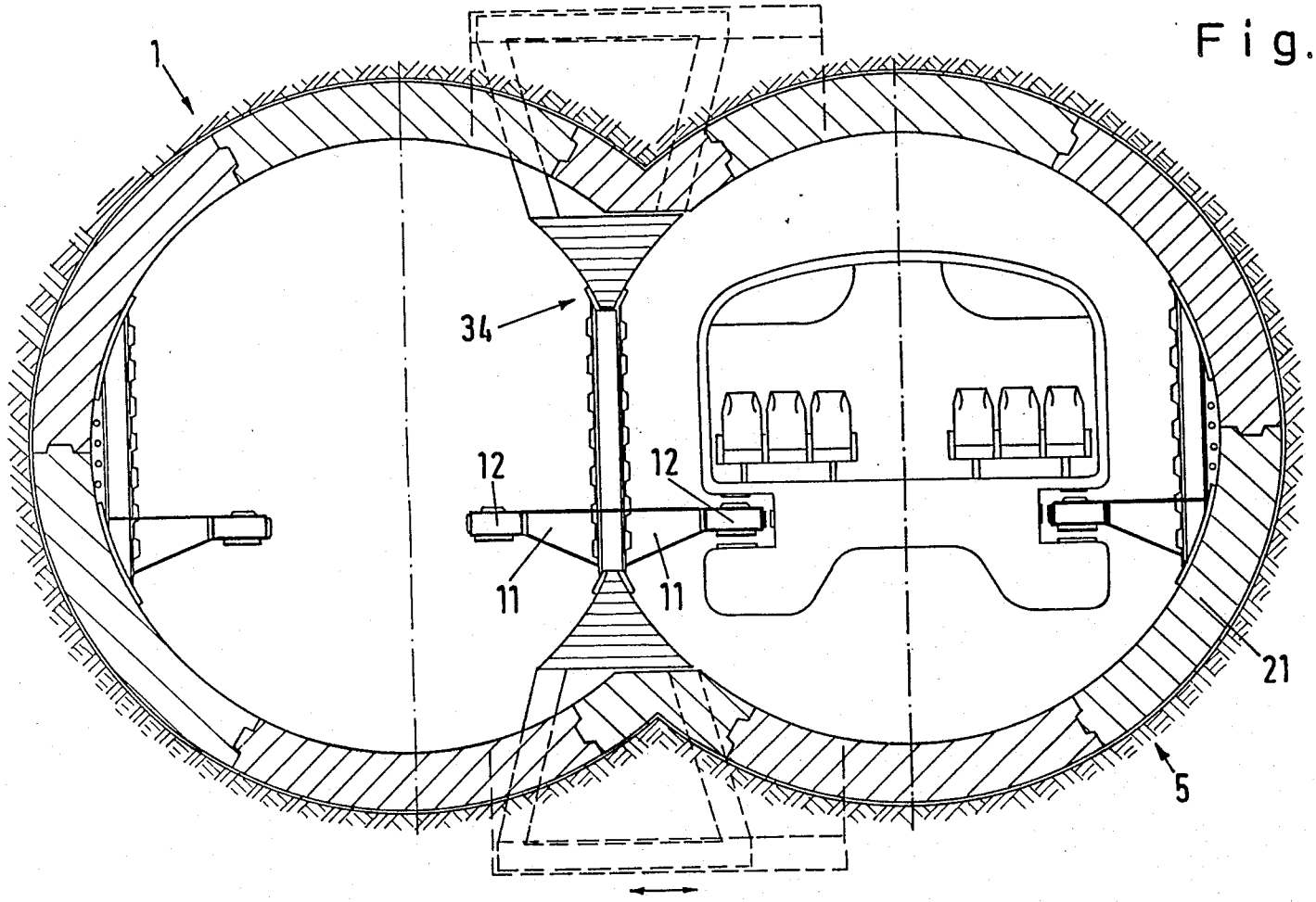

There are shown in:

FIG. 1*a*, 1*b* a schematic view of a track layout between two agglomerations, FIG. 2*a*, 2*b* a top view of a station arrangement in this operating system, FIG. 3 and 4 sectional views of embodiments of a tunnel tube, FIG. 5 a schematic top view of a branching point, wherein the switch formed at this branching point is set for travel along the curved stretch of the branch tunnel, FIG. 6 a sectional view taken along the line (1—1) of FIG. 5, FIG. 7 a sectional view taken along the line (2—2) of FIG. 5, FIG. 8 a sectional view taken along the line (3—3) of FIG. 5, FIG. 9 a sectional view taken along the line (4—4) of FIG. 5, FIG. 10 a schematic top view of a further embodiment of the branching point, wherein the switch formed therefrom again is set for travel in the curved stretch of the branch tunnel, FIG. 11 a sectional view taken along the line (5—5) of FIG. 10, FIG. 12 a sectional view taken along the line (6—6) of FIG. 10.

In FIGS. 1*a* and 1*b*, two agglomeration centers, I and II, are shown. In the agglomeration centers I and II, traffic centers 3 are present. These traffic centers 3 can be, for example, railroad stations or trains stations of the Federal Railways.

The operating system extends between the agglomerations I and II.

Below the traffic center 3, railway stations 4 connected therewith are shown, which are designed as passenger stations. With these stations 4, individual branch tunnels 7 are associated. These branch tunnels 7 are connected through branching points 6 with the directional tunnels 1 in which the train traffic between the agglomeration centers I and II takes place. The connection can be made through the shown branching points 6, wherein branch tunnels 5 are provided. In the operating system represented in FIG. 1*a* and 1*b*, the stations 4 with their associated branch tunnels 7 lie above the directional tunnels 1.

In the area of the branch tunnels 7 associated with the stations 4, special auto travel and/or express freight stations 8 can be provided, which can have their own connection to the earth surface.

It is of particular significance that the branch tunnels 7 associated with the stations 4 can be blocked airtightly in a controlled manner from the directional tunnels 1, wherein this barrier is so designed that after the opening of the directional tunnels 1, trains can travel through the branch tunnels 5 to the stations 4 and again depart therefrom. A barrier is formed in order to keep away from the stations 4 the air blasts and shock waves produced by the trains traveling through the directional tunnels.

As is shown further, an aeration and venting system 9 can be provided, which in addition to aeration and venting can also serve for the control of pressure relationships in the tunnels. Particularly advantageously, a service tunnel 2 can be provided between the directional tunnels 1, which as an example can be used for bringing in new drive tracks or for repairs and servicing.

As FIG. 3 shows, on the inner wall 14 of the tube of the directional tunnel 1, posts 10 are installed. These posts 10 are installed on this inner wall 14 by means of flanges 13 and anchors, not shown, in a predetermined position, whereby through this mounting gross tolerances can be balanced and banking can be built in. On these posts 10 are mounted consoles 11, wherein this installation also is adjustable, in order to balance the fine tolerances. The consoles 11 carry the drive rails 12 for a magnetic train. The drive rails 12 likewise are mounted adjustably on the consoles 11.

A magnetic train car, which is schematically represented by 15, exhibits an undercarriage 16 which cooperates with the drive rails 12 and cradles the drive rails 12.

It should be recognized that forces are favorably transferred from the magnetic train car 15 onto the drive rails 12, wherein the forces taken up by the drive rails 12 as transverse and horizontal forces, and also as moments, can be very easily led into the tubes of the directional tunnel 1.

Since the magnetic train can travel at a very high speed, it is useful for the posts 10 to carry a covering wall in order to decrease the resistance to flow and to inhibit from the beginning the unpleasant travel noises.

The posts 10 further can receive supply lines.

As shown, the construction is of the type that in the floor area of the tube of the directional tunnel 1, rails 17 are mounted. Along these rails, maintenance and supply trains can travel. The free space under the magnetic train 15 proper can be used for the purpose of emergency exit, wherein the escape hatch 18 shown in FIG. 3 can be lowered to the floor section.

In the sectional representation of the directional tunnel 1 shown in FIG. 4, a magnetic train car 15 is shown, whose tracking magnets 19, which cooperate with the drive rails 12, in order to guide the magnetic train car 15 securely in its track, are designed in a particular manner. It might happen that because of earth stresses in particular locations of the railroad line, the directional tunnel 1 is deformed to a small extend, so that the drive rails 12 slightly change their reciprocal distances, which define the track. In order to compensate for that, the tracking magnets 19 are designed to be self-adjusting for balancing the tolerances towards and away from the drive rails 12. This adjustment and control of the tracking magnets 19 can be accomplished in a manner known per se.

FIG. 5 shows a top view of a branching point 6. At this branching point 6, the directional tunnel 1 intersects the toroid 21 of the branch tunnel 5. Hereby, an intersection is formed between both tube-shaped elements. In the region of this intersection, a switch is formed between the points A and C, wherein in A lies the beginning of the switch and in C the end of the switch. According to the representation in FIG. 6, this switch is set for travel in the curved stretch of the switch, i.e., in the toroid 21 of the branch tunnel 5. As shown schematically, in this region the directional tunnel 1 and the branch tunnel 5 are subdivided into switch segment sections 22. These switch segment sections 22 are designated in FIG. 6 [sic! Tr.] by 22I to 22VI, wherein each switch segment section 22 is structurally subdivided. This structural subdivision, which will be explained in more detail, is indicated by the subscripts 1-n.

As is shown in FIG. 6, in the switch section A-B segments of the directional tunnel 1 and of the branch tunnel 5 are mounted in a turret 30. The turret 30 is surrounded by a roller ring 29, which is positioned on rollers 33. By means of a drive, not shown, the roller ring 29 and with it the turret 30 can be rotated. In the switch segment 28, 22II1 of the toroid 21, a magnetic train car 15 is indicated schematically, which means that the switch is set for travel into the curved stretch of the toroid 21. For this setting, the switch segment 27, 22II1 of the directional tunnel 1 has been rotated out of its operating position. As shown, both switch segments 27, 22II1 and 28, 22II1 have an angular distance from each other of 180° and are mounted so that they can be placed in the respective operating position by a cyclic rotation. In the case of the embodiment shown, the set switch segment is shown correctly. The segment rotated out finds itself in a position which can be designated as upside down. When for the representation in FIG. 6 the turret 30 is rotated by 180°, the switch is set for operation for travel in the straight stretch of the directional tunnel 1.

As shown in FIG. 7, at a location, farther removed from the beginning A of the switch the switch segment 28, 22IIn has moved farther away from the switch segment 27, 22IIn of the directional tunnel 1. This means that on the way towards point B, the turret 30 must have a progressively larger diameter. It should be pointed out here that the turret 30 does not necessarily have to have a solid wall construction. There also exists the possibility of placing the switch segments 27 and 28 of the directional tunnel 1 and of the branch tunnel 5 in a roller ring 29 by means of latticework-like braces.

In order not to allow the radial measurements of the rotatable switch construction elements to become much too large, especially in locations which lie farther away from the beginning A of the switch, for example, at point B on FIG. 5 a switch construction is employed which is represented in a cross-section in FIGS. 8 and 9. At this location, the directional tunnel 1 and the branch tunnel 5 are formed in the style of a plug of a two-way stopcock. FIGS. 8 and 9 are cross-sectional representations of points lying at different distances from the beginning A of the switch, wherein it is again shown that the toroid 21 of the branch tunnel 5 continuously moves farther away from the sections of the directional tunnel 1. In the case of the sections represented, one deals with portions of the switch section 22V.

As shown, the toroid 21 of the branch tunnel 5 exhibits a sector-shaped cutout 23. Into this sector-shaped cutout 23, extends with a snug fit the cylinder wall 24 of a rotational cylinder segment 25. This rotational cylinder segment 25 is rotatably mounted on rollers 33 and can be rotated by means of a drive, not shown. This rotational cylinder 25 exhibits in its cylinder wall 24 a convex, retracted, cylindrical section 26. The radius of curvature of this convex, retracted, cylindrical section 26 corresponds to the inner radius of the toroid 21, so that in the position shown in FIGS. 8 and 9, this convex, retracted, cylindrical section 26 can form a complement of the toroid 21 inside the sector-shaped cutout 23. For this purpose, a console 11 with a drive rail 12 extends outwardly from a portion of the convex, retracted, cylindrical section 26. Inside the rotational cylinder segment 25 is positioned a switch segment 22 of the directional tunnel 1 at an angular distance of 180° from the convex, retracted, cylindrical section 26 in such a way that by a cyclic rotation of 180°, the switch segment 22 of the directional tunnel 1 can be placed in operating position. In FIGS. 8 and 9, the magnetic train car 15 outlined in FIGS. 8 and 9 travels in the curved stretch of the branch tunnel 5. After a 180° rotation of the rotational cylinder segment 25, the switch is set for a straight ride. The divergence of the toroid 21 and the switch segment of the directional tunnel 1 shown in FIG. 9, as compared with FIG. 8, requires a further progressively larger diameter of the rotational cylinder segment 25. A much too large increase of that diameter is precluded by a construction which will be again explained in connection with FIG. 12.

In FIG. 10, an embodiment of the branching point 6 is shown, wherein the sections A-B and the section before the switch end C are represented in a simplified manner. The sections 3—3 and 4—4 indicated in FIG. 5 are likewise represented in FIGS. 8 and 9.

In this embodiment, starting from the beginning A of the switch, the drive rail is formed in the manner of a flectional switch. In order to be able to switch from travel in the straight stretch of the directional tunnel 1 to travel along the curved stretch of the branch tunnel 5, as is shown in FIG. 11, a semicylindrical section 31, together with a drive rail 12 are designed laterally slidable. Between the points A and B the semicylindrical sections 31 also are subdivided into segments. For executing the lateral sliding of the semicylindrical sections 31, a sliding mechanism is shown schematically. This sliding mechanism can be fashioned as desired in a known manner. It is only significant that, as an example, the semicylindrical sections 11 represented on the right in FIG. 11 are slidable between points A and B of the switches in such a way that they form a portion of the toroid 21 for the travel along the curved stretch of the branch tunnel 5. The drive rails 12 lying in the stationary semicylindrical section 32 of the directional tunnel 1 are formed, as shown schematically, for driving on and off, so that, in the manner of a flectional switch it is possible to drive off the drive rails 12 of the slidable semicylindrical sections 31.

As shown in FIG. 12, in the region before the switch end C, the formation of the switch can be such that between the directional tunnel 1 and the toroid 21 of the branch tunnel 5, a slidable wall 34 is formed, which on both sides carries drive rails 12 on consoles 11. For sliding this slidable wall 34, a sliding mechanism is shown schematically. In the representation of FIG. 12, this slidable wall 34 is slid into the directional tunnel 1 in such way that the other side of that slidable wall 34 completes the toroid 21 for travel operation therein. For travel in the directional tunnel 1, this slidable wall 34 is slid into the other end position in which the left hand side of the slidable wall 34 shown completes the directional tunnel 1 for a travel operation therein.

I claim:

1. Operating system for a long distance, underground, track-riding, high speed transportation means between traffic centers of agglomerations or other centers, comprising:

high speed trains with individual propulsion are driven in single track directional tunnels (1), especially provided with a ventilation system (9), which are formed over their entire length as tubes with a constant profile, that in the traffic centers (3), the stations (4) are disposed in branch tunnels (5, 7) running parallel to the directional tunnels (1), which are formed as tubes of constant profile, and that at branching points (6) of these tubes, wall elements of the directional tunnels (1) and/or branch tunnels (5) are slidable into each other and/or relative to each other and/or rotatable;

the stations (4) lie at a different height than the directional tunnels (1), especially above those;

at least one service tunnel (2) runs between the directional tunnels (1);

the high speed trains are magnetic trains driven by linear motors; and on the inner wall of the directional tunnel (1), posts (10) are fastened, on which consoles 11 are adjustably mounted, and that on the consoles (11), drive rails (12) are adjustably mounted.

2. Operating system of claim 1, characterized by that the adjustable fastening of the posts (10) are performed with flanges (13) and anchors.

3. Operating system of claim 1, characterized by that the tracking magnets (19) of the magnetic train (15), for balancing track changes of the drive rails (12)

are adjustable relatively thereto by means of a controlled adjustment motor.

4. Operating system of claim 1, characterized by that at the branching points (6), the cylindrical directional tunnel (1) forms an intersection with the toroid (21) of the branch tunnel (5), that in the region (A-C) of that intersection the directional tunnel (1) and the toroid (21) are subdivided into a number of sections of switch segments (22I–22VI), and that in each switch segment, segment construction elements (22–30) are designed rotatable and/or slidable.

5. Operating system of claim 4, characterized by that in the region (A-C) of the intersection, the toroid (21) of the branch tunnel (5), exhibits in the wall section adjacent the directional tunnel (1) sector-shaped cutouts (23), that cylinder walls (24) of rotational cylinder segments (25 $IV_{1-n}$; 25$V_{1-n}$; 25$VII_{1-n}$) extend into those sector-shaped cutouts (23) with a snug fit, that each cylinder wall (24) exhibits a convex, retracted, cylindrical section (26), whose radius of curvature is equal to the inner radius of the toroid (21), that from this convex, retracted, cylindrical section (26), a drive rail (12) extends outwardly, and that in each rotational cylinder segment (25$V_n$), at an angular distance of 180° from the convex, retracted, cylindrical section (26), a switch segment (22) of the directional tunnel (1) is mounted.

6. Operating system of claim 4, characterized by that in the region (A-B) of the intersection, switch segments (27, 28) of the directional tunnel (1) and the toroid (21) are mounted in a turret (30) cyclically rotatable into the respective operating position at an angular distance of 180° from each other.

7. Operating system of claim 4, characterized by that in the region (A-B) of the intersection extending from the beginning (A) of the switch, semicylindrical sections (31) of the tubes of the directional tunnel (1) are slidable in the manner of a flectional switch into the geometric loci of the corresponding sections of the toroid (21) of the branch tunnel (5), and that the drive rails (12) of the associated stationary semicylindrical sections (32) of the tubes of the directional tunnel (1) are mounted in this section to be driven on and off, in the manner of a flectional switch.

8. Operating system of claim 4, characterized by that in the region of the switch end (B) of the intersection, a wall (34) common to the directional tunnel (1) and the toroid (21) is slidably mounted therebetween.

9. A one-directional tunnel system for a high-speed train comprising:

a first tunnel section having a pair of rails for support of said train;

a second tunnel section having a pair of rails for support of said train and being generally aligned with and separated from said first tunnel section;

a third tunnel section having a pair of rails for support of said train and being horizontally beside said second tunnel section and separated from said first tunnel section;

means for selectively joining said first tunnel section to one of said second tunnel section and said third tunnel section;

said means for selectively joining including at least one of a first tunnel switching section;

said first tunnel switching section being rotatable about an axis generally parallel to said first tunnel section;

said first tunnel switching section having a first tunnel portion including a pair of said rails for support of said train and being alignable with said first tunnel section and said second tunnel section and said pairs of said rails thereof;

said first tunnel switching section having a second tunnel portion having at least one rail for support of said train and being alignable with said first tunnel section and said third tunnel section and said pairs of said rails thereof; and said first tunnel portion and said second tunnel portion of said first tunnel switching section being on opposite sides of said axis.

10. The one-directional tunnel system according to claim 9, wherein said second tunnel portion is upside down when said first tunnel portion is aligned with said first tunnel section and said second tunnel section and said first tunnel portion is upside down when said second tunnel portion is aligned with said first tunnel section and said third tunnel section.

11. The one-directional tunnel system according to claim 10, wherein said second tunnel portion includes a pair of said rails for support of said train and said pair of said rails of said second tunnel portion are alignable between said pair of said rails of said first tunnel section and said pair of said rails of said third tunnel section.

12. The one-directional tunnel system according to claim 10, wherein said one rail of said second tunnel portion is parallel with a single extended rail of said third tunnel section when said second tunnel portion is aligned between said first tunnel section and said third tunnel section.

13. The one-directional tunnel system according to claim 10, wherein said means for selectively joining includes at least a second tunnel switching section between said one of said first tunnel switching sections and said second and said third tunnel sections, said second tunnel switching section includes a first tunnel wall portion with a rail secured thereon and a second tunnel wall portion with a rail secured thereon, said second tunnel switching section is selectively slidable into and out of extended ends of each of said second tunnel section and said third tunnel section, said first tunnel wall portion is alignable with said second tunnel section as said rail of said first tunnel wall portion is parallel with an extended rail on said extended end of said second tunnel section, said second tunnel wall portion is alignable with said third tunnel section as said rail of said second tunnel wall portion is parallel with an extended rail of said extended end of said third tunnel section, said first tunnel wall portion is located in said extended end of said second tunnel section when said second tunnel wall portion is aligned with said third tunnel section, and said second tunnel wall portion is located in said extended end of said third tunnel section when said first tunnel wall portion is aligned with said second tunnel section.

14. The one-directional tunnel system according to claim 13, wherein said first tunnel wall portion is aligned with said first tunnel portion of said first tunnel switching section and said second tunnel section when they are aligned and said second tunnel wall portion is aligned with said second tunnel portion of said first tunnel switching section and said third tunnel section when they are aligned.

15. The one-directional tunnel system according to claim 10, wherein said means for selectively joining includes at least a third tunnel switching section between said one of said first tunnel switching sections and said first tunnel section, said third tunnel switching section includes a pair of bendable rails with one end aligned with said pair of said rails of said first tunnel section and with an opposite end selectively alignable with said pair of said rails of first tunnel portion and with said one rail of said second tunnel portion.

16. The one-directional tunnel system according to claim 15, wherein said third tunnel switching section includes at least one transversely movable tunnel wall half supporting said bendable rail of said pair of said bendable rails at the side thereof toward said third tunnel section.

* * * * *